United States Patent [19]

Trevarthen

[11] Patent Number: 4,586,208

[45] Date of Patent: May 6, 1986

[54] FLOOR MAINTENANCE MACHINE AND METHOD

[75] Inventor: Donald S. Trevarthen, Golden Valley, Minn.

[73] Assignee: Tennant Company, Minneapolis, Minn.

[21] Appl. No.: 682,612

[22] Filed: Dec. 17, 1984

[51] Int. Cl.[4] ..... A47L 11/30

[52] U.S. Cl. ..... 8/158; 15/321; 15/353; 210/240; 210/412

[58] Field of Search ..... 15/321, 328, 353; 8/158; 210/167, 172, 232, 240, 412

[56] References Cited

U.S. PATENT DOCUMENTS

| | | | |
|---|---|---|---|
| Re. 27,792 | 10/1973 | Howerin et al. | 15/321 |
| 1,892,347 | 12/1932 | Jerome . | |
| 2,003,215 | 7/1934 | Nadig | 15/50 |
| 2,223,963 | 12/1938 | Nadig | 141/1 |
| 3,011,206 | 11/1957 | Breither | 15/320 |
| 3,079,285 | 2/1963 | Rockwell | 134/10 |
| 3,431,582 | 3/1969 | Grave | 15/321 |
| 3,447,545 | 6/1969 | Lawter | 134/101 |
| 3,753,777 | 8/1973 | Thomsen et al. | 134/6 |
| 3,848,804 | 11/1974 | Prestwich | 239/160 |
| 3,869,749 | 3/1975 | London et al. | 15/353 X |
| 3,877,902 | 4/1975 | Eriksson et al. | 55/337 |
| 3,976,501 | 8/1976 | Blue | 134/10 |
| 4,096,084 | 6/1978 | Thomsen et al. | 252/173 |
| 4,295,244 | 10/1981 | Herpers et al. | 15/320 |
| 4,348,783 | 9/1982 | Swanson et al. | 15/320 |
| 4,377,017 | 3/1983 | Herpers et al. | 15/320 |
| 4,466,155 | 8/1984 | Grave | 15/321 |

OTHER PUBLICATIONS

"Sweepers, Scrubbers, Scarifiers, Floor Coatings" ©1982, Tennant Company 1-82:CAT.
Tennant Bulletin "520 Power Scrubber".
Tennant Bulletin "527 Power Scrubber".
Tennant Bulletin "432 Scrubbers".
Tennant Trend Bulletin "Floor-Care Products That are Better Than They Have to Be".
"Extravac TM 500/750 Carpet Extractors", Sales Spec Sheet on Tennant Trend Model 750.
Parts List of the Extravac 500/750 Extractor.
"Operating Instructions and Routine Maintenance", Booklet-500/750 Extractor.
American Lincoln 1030 Auto Scrubber.
Parts List for Tennant Trend Powerbrush 350.

*Primary Examiner*—Philip R. Coe
*Attorney, Agent, or Firm*—Kinzer, Plyer, Dorn & McEachran

[57] ABSTRACT

This is a floor maintenance machine in the nature of a carpet extractor and a method of operating it whereby it may be operated either as a single cycle unit or a recycling unit. It also includes a method and apparatus for converting a carpet extractor so that the running time between solution changes is greatly extended. There is also a back flushing arangement of the filter which extends running time. The unit also has a liquid surge control. It also includes or encompasses a convertability cart which may function in several ways.

12 Claims, 7 Drawing Figures

Fig. 1.
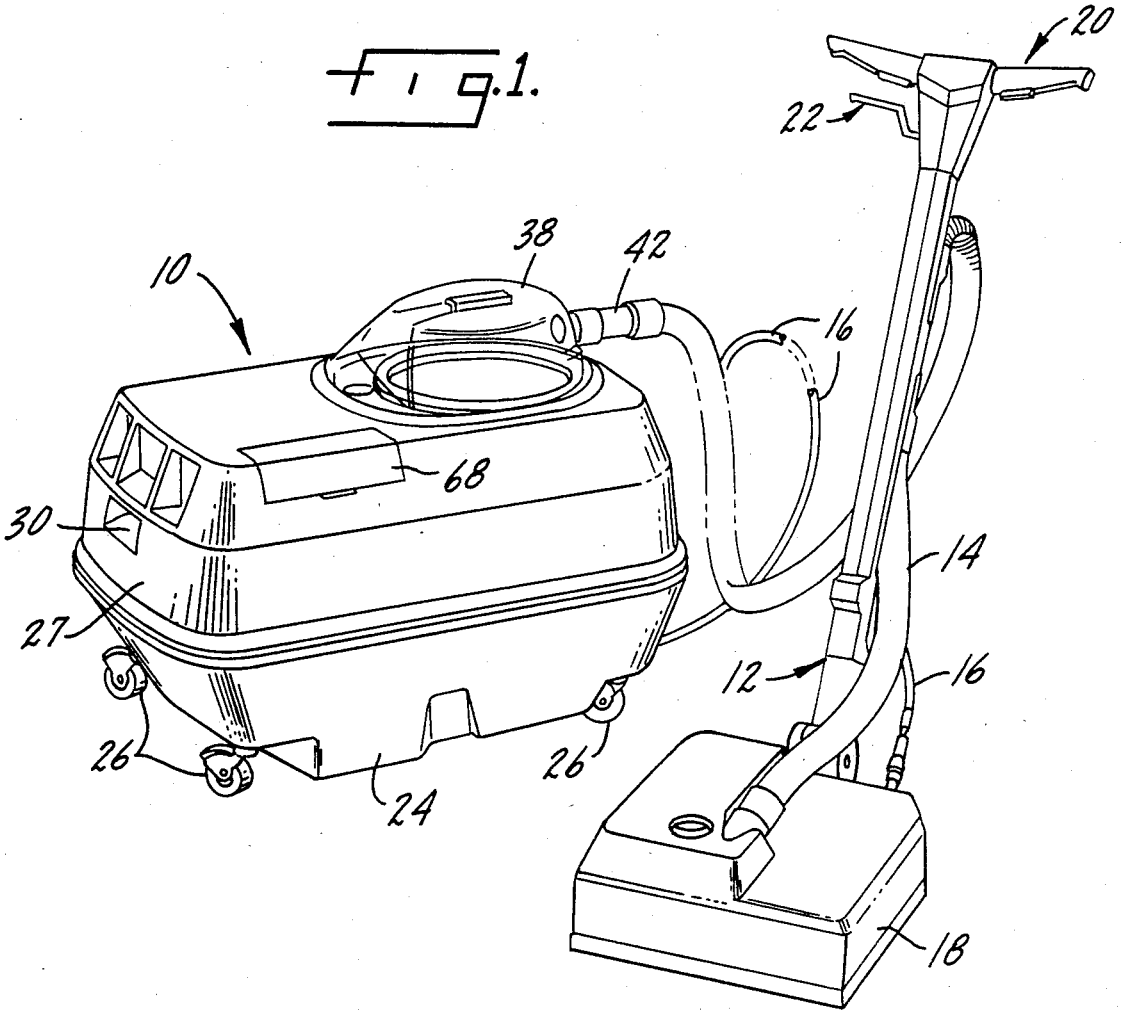
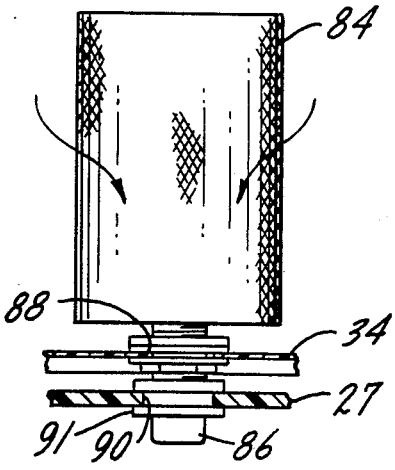
Fig. 4.
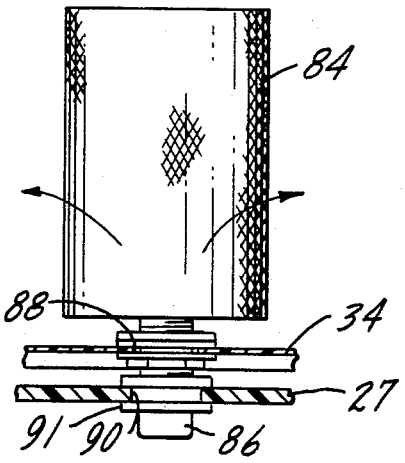
Fig. 5.

FLOOR MAINTENANCE MACHINE AND METHOD

SUMMARY OF THE INVENTION

A primary object of the invention is a method and apparatus for a floor maintenance machine in the nature of a carpet extractor which enables it to operate either as a single cycle unit or as a recycling unit.

Another object is a method or procedure whereby a standard carpet extractor may be converted to a recycling unit.

Another object is a recycling carpet extractor which uses a back flush to clean its filter so that the operating time of the unit is extended.

Another object is a surge control for such a unit.

Another object is a convertability cart.

Other objects will appear from time to time in the ensuing specification and drawings.

BRIEF DESCRIPTION OF THE DRAWINGS

FIG. 1 is a perspective of the unit.

FIG. 4 is diagrammatic of the filter in FIG. 2.

FIG. 5 is like FIG. 4 but showing the back flushing action.

DESCRIPTION OF THE PREFERRED EMBODIMENT

In FIG. 1 a floor maintenance machine in the form of a carpet extractor is shown with a main housing or cannister indicated generally at 10 connected to a wand indicated generally at 12 by a solution vacuum hose assembly which includes a conduit or vacuum hose 14 and solution supply tube 16. The cleaning head 18 of the wand may have a power operated brush, not shown, or it may be strictly a vacuum pick-up. The handle mechanism 20 at the upper end may have suitable controls indicated generally at 22.

Figure 2:
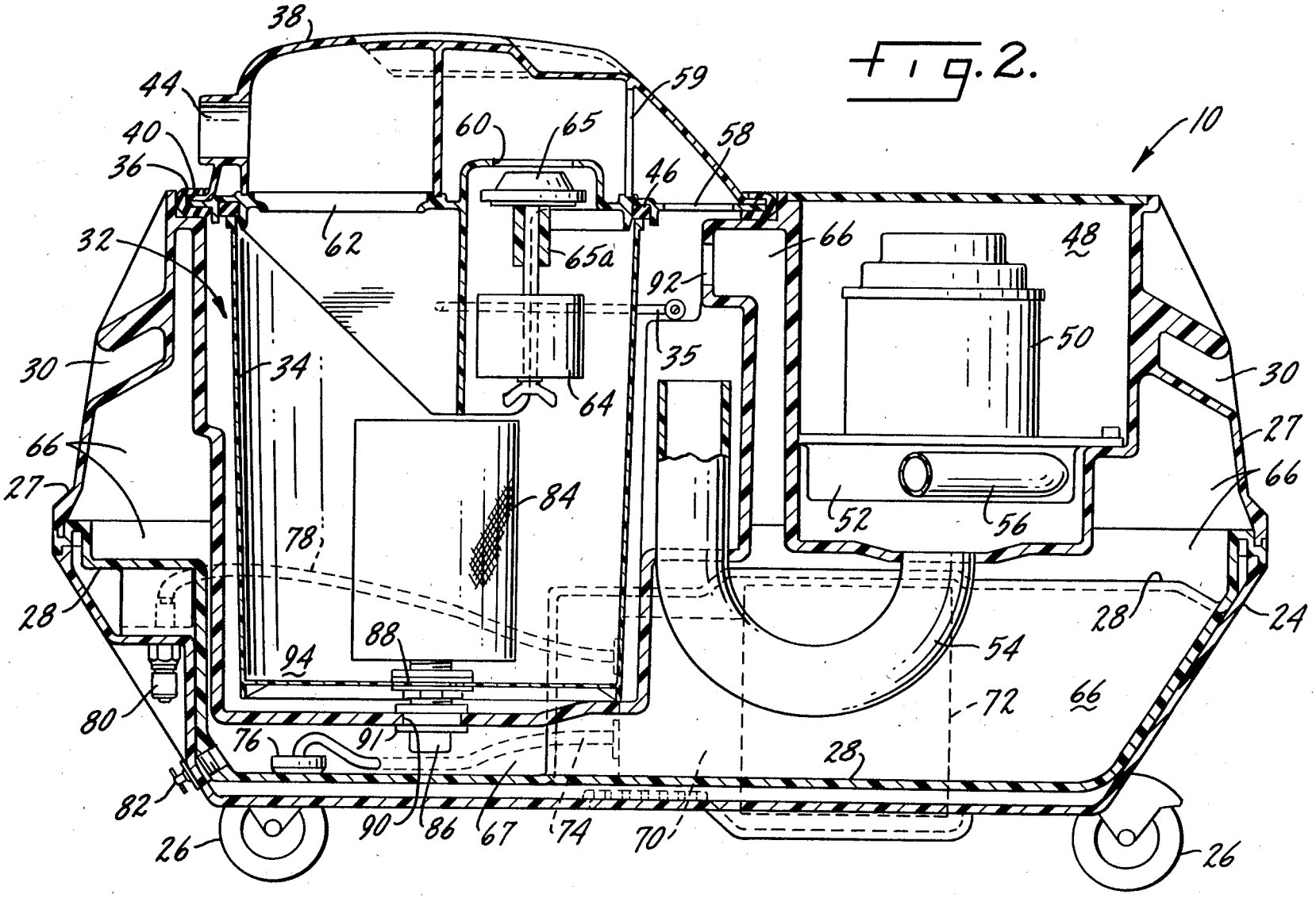
FIG. 2 is a longitudinal section through the extractor housing.

As shown in FIG. 2, the canister is in the nature of a housing with a base 24 having suitable casters 26 and a solution assembly therein which includes upper and lower halves 27 and 28 which, with the base, provide a suitable housing or enclosure for various operating parts and a solution chamber. The top or upper half 27 may have suitable molded in handle areas 30 at each end, if desired. Upper and lower halves 27 and 28 may be bonded together in a fluid-tight joining. Base 24 may be attached with bolts to permit service access.

The top half 27 has a suitable well or cavity 32 formed therein to receive a recovery container or bucket 34 with a handle or bail 35. The upper opening 36 of the cavity or well 32 is closed by a removable dome 38 which may be transparent and is provided around its peripheral edge with a suitable seal 40 constructed and arranged to provide an air-tight seal with the housing when the dome is in place. As shown in FIG. 1, one end 42 of the vacuum hose 14 fits into a socket in the dome in a suitable manner, as at 44 in FIG. 2. The lower or bottom surface of the dome is also formed with a generally circular downwardly disposed channel and seal 46 to engage and seal against the upper end of the recovery bucket or chamber 34.

The housing also has a second cavity or chamber 48 which encloses or houses an electric motor 50 that drives a vacuum fan 52 which is constructed and arranged to exhaust air from the recovery container 34 in the first cavity or well 32 through a connection or duct 54 which is sealed or cemented where it enters and leaves chamber 66. The discharge 56 from the vacuum fan may exhaust to atmosphere through the side or end of the housing in any suitable manner, not shown.

The vacuum thus created is communicated through openings 58 and 59 into the interior of the dome, then through opening 60 to the inside of the sealed recovery bucket or chamber 34. In turn, the vacuum is communicated from the recovery container or bucket 34 by an opening 62 and then to the vacuum hose 14 through the socket 44. A float 64 is arranged so that in response to a certain level of solution in the bucket or container 34, the opening 60 will be closed by a valve 65 in a guide **65*a* preventing solution from flowing through openings 59 and 58, through the connection 54**, and into the vacuum fan.

The inside of the housing or canister defines a solution chamber 66 which may be filled through a suitable opening which has a door or cover 68, shown in FIG. 1. A solution pump 70, shown in broken lines, driven by a suitable motor 72 is constructed and arranged to withdraw solution from the well 67 of the chamber 66 by a tube 74 and pick-up head 76 and to discharge it through a connection 78 to a quick disconnect 80 to which the solution tube 16, shown in FIG. 1, is or may be connected. The result is that the pump 70 will pick up clean solution from the solution well 67 of the chamber 66 and supply it under pressure to the head 18 of the wand where it will be jetted into the carpet. By a pick-up arrangement, not shown, in the head 18 of the wand, dirty solution from the carpet will be picked up by the vacuum or negative pressure from the vacuum fan 52 and drawn through tube 14 into the dome or cover 38, and through opening 62 into the interior of the bucket or container or chamber 34. A suitable drain 82 may be provided at a suitable point in the bottom of the housing so that all the contents of the solution chamber 66 may be drained, when desired.

The bottom of the recovery container or bucket 34 has a suitable upstanding screen or filter 84 which is shown as generally cylindrical and is mounted on a suitable pipe 86 which extends through an opening 90 in the bottom of chamber 32 into the well 67 of solution chamber 66. Various washers, fittings and seals may be provided around pipe 86 so that a fluid-tight seal is provided around the opening 88 in the bottom of the chamber or bucket 34. The opening 90 in the bottom of chamber 32 is provided with a suitable rubber grommet 91 or the like through which the pipe 86 extends. The result is that fluid may flow through the screen or filter 84 and through the pipe 86 into the solution chamber well 67 but may not pass into the well or cavity 32.

The upper end of the cavity or well 32 is provided with a suitable opening 92 so that the vacuum on top of the solution in the recovery bucket 34 under the dome is communicated to the top of the solution chamber 66.

The use, operation and function so far are as follows: A suitable amount of clean solution is poured through opening 68 into the solution chamber 66 in the canister or housing. When the unit is turned on, the pump 70 forces this clean solution through the various connections 78, 80 and tube 16 into the head 18 of the wand. After being jetted into the carpet and performing its cleaning function, the dirty fluid in the carpet is picked up by the vacuum which is communicated to the head 18 through the tube 14 and is returned to the dome 38 and collected in the bucket or container 34. The vacuum created by the vacuum fan 52 in addition to being applied to the container 34 is also communicated through opening 92 to the inside of the solution container 66 so that the pressure on top of the clean solution in container 66 and on the dirty solution in container 34 is approximately the same. As the dirty solution accumulates in the recovery container 34, it is allowed to flow through the filter 84 and pipe 86, as diagrammatically shown in FIG. 4, back into the solution chamber 66 so that it may be used over again. A substantial amount of dirt and foreign matter will collect on the outside of the upstanding filter unit 84. From time to time the head 18 of the wand will be lifted up off of the carpet or the vacuum turned off, which momentarily reduces the amount of vacuum, which is to say raises the pressure on top of the solution in container 34. The opening 92 between the two chambers is sized so that there is a momentary lag during which the air pressure on top of the solution in container 34 is higher than it is on top of the solution in container 66. As soon as the head 18 of the wand is returned to full contact with the carpet or the vacuum is turned on again, full vacuum will be applied first to the inside of container 34. Again, there is a slight delay before full vacuum is communicated to the solution chamber 66 after it is applied to the recovery container 34. The result is that a momentary imbalance occurs in which the pressure on top of the solution in container 66 is greater than it is in the container 34 which will cause a momentary backflow of solution through the pipe 86 and filter 84, shown diagrammatically in FIG. 5. During this backflow, the foreign material collected on the exterior of the filter 84 will be forced out of the openings in the filter and will fall into the bottom of the bucket 34. It will be noted that the filter is spaced somewhat above the bottom of the container so that a sump 94 is provided in the bottom of the bucket which will collect the foreign matter. At the same time, gravity settling of dirt and debris will take place during normal operation so that material collecting in the sump 94 in the bottom of the bucket as a result is a combination of both gravity settling and a backwash or reverse flow, although gravity settling also applies during the back flush. The sizing of the openings or mesh of the filter 84 and the size of the opening 92 communicating the vacuum between the two chambers is important and should be selected so that a suitable but not excessive back-flush takes place in response to the variations in the vacuum.

While it has been said that this variation in vacuum takes place due to the head 18 of the wand temporarily coming up off of the carpet, it should be understood that variations will also take place when the unit is being used on tufted or other type of uneven surfaces.

The result is a recycling carpet extractor which provides for the solution to be used a number of times until it is sufficiently dirty. At that point, the entire unit may be drained through the drain 82 and then the bucket or container 34 may be taken out and thoroughly rinsed so that all of the collected foreign material is disposed of. Then the solution container 66 is refilled with new solution and the process started over again. The closure 68 should be constructed and arranged so that it seals sufficiently against the vacuum which is applied inside the solution container.

Figure 3:
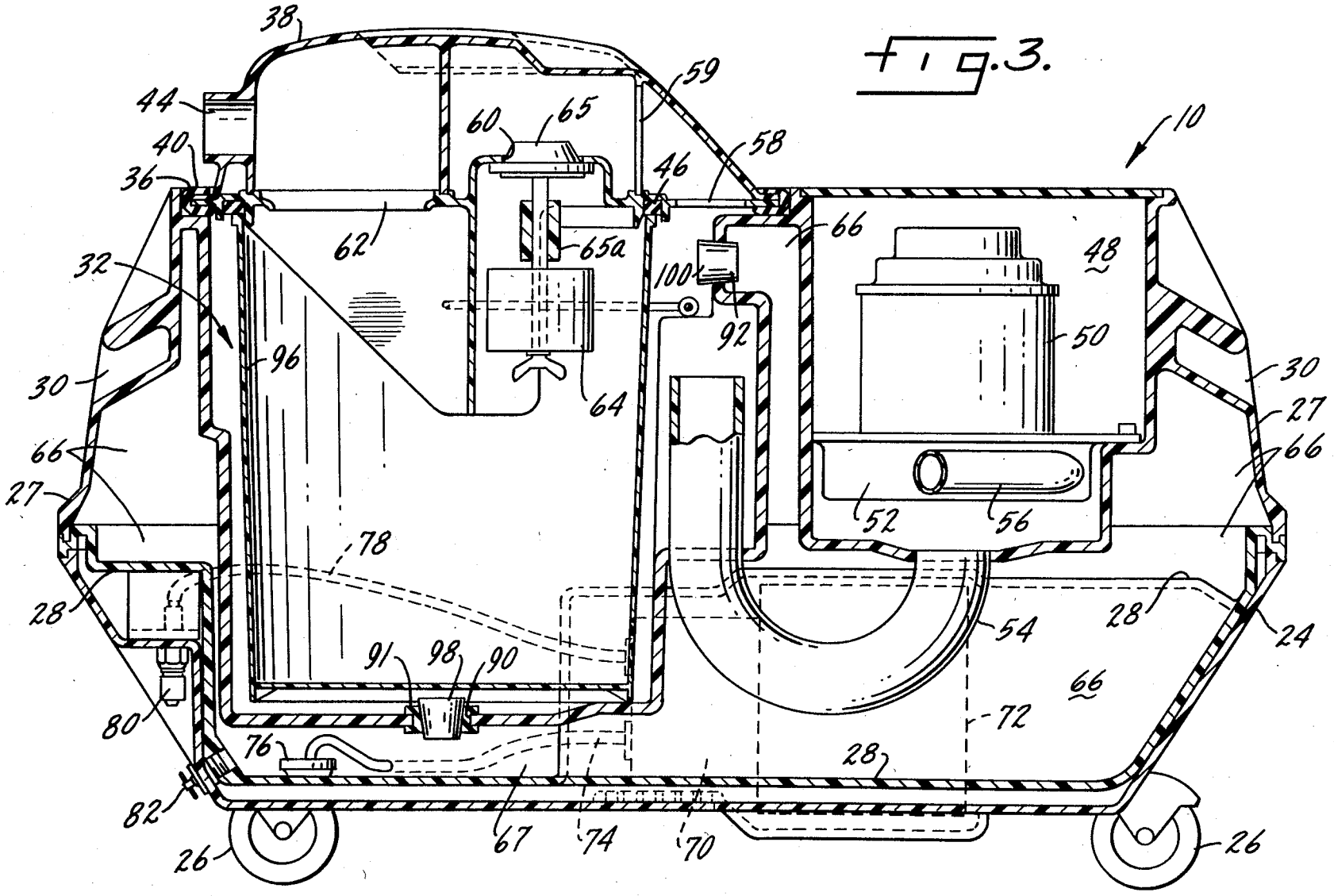
FIG. 3 is similar to FIG. 2 with the unit on a different operating cycle.

It is highly desirable that such a unit also be constructed and arranged so that it may operate as a non-recycling unit. This arrangement is shown in FIG. 3 in which a container 96 is provided which does not have a filter and hole in the bottom. In addition, the hole 90 in the bottom of the well of the housing has been closed by a suitable plug 98. In addition, the vacuum communication port 92 has also been closed by a suitable plug 100. The result is that the unit will operate as a conventional, single cycle carpet extractor. The chamber 66 will be filled through the opening 68. Then the unit will be used in the conventional manner and each time the bucket 96 is filled with dirty solution, the operator or user will take off the dome 38, remove the container and empty it. When all of the solution has been used, the solution chamber will be filled with new solution and the cycle or process started over again.

This has the advantage that the same basic unit may be operated either as a single cycle device or a recycling device. Two simple plugs and a conventional bucket or container 96 may be supplied along with the basic machine shown in FIG. 2 and the user may operate it either way with a minimum of effort to go from one to the other. The user may set up the machine to operate one way, for example, as a normal cycle machine like in FIG. 3, and later, if he so desires, he may obtain a bucket or container with a filter of the type shown in FIG. 2, take out the plugs 98 and 100, insert the pipe 86 and operate the unit as a recycling carpet extractor. The conversion from one to the other may be done with a minimum of expense and effort.

When the unit is operating on a single cycle with plugs 98, 100 in place as shown in FIG. 3, the filling opening cover 68 should be constructed and arranged so that airflow may take place, i.e., air should be vented in so that the air pressure on top of the solution in container 66 is atmospheric. Alternatively, cover 68 may be a tight fit and a separate air vent may be provided.

When operating as a recycling carpet extractor, it is important that the sizing of the openings in the filter 84 be coordinated to the opening 92 that communicates the vacuum to the solution container 66 so that at the same time that the back flush depicted in FIG. 5 is taking place, the filter 84 also will serve as a damper which prevents violent surges in the flow of solution back and forth through the connection 86 as the vacuum varies. Without the dampening affect of the filter 84 or some other means, quite wide swings in fluid level have been known to take place.

While it has not been shown, it will be understood that suitable electrical connections are or should be provided. If a power brush is used in the wand, there should also be an electrical connection to the head of the wand so that the brush is electrically driven.

Whereas, the cleaning unit shown in FIG. 2 is in the form of a filter, it should be understood that under suitable conditions and in accordance with other applications, other types of separating or cleaning units could be used other than a specific filter. For example, in certain situations a centrifuge or a settling chamber might be appropriate.

Figure 6:
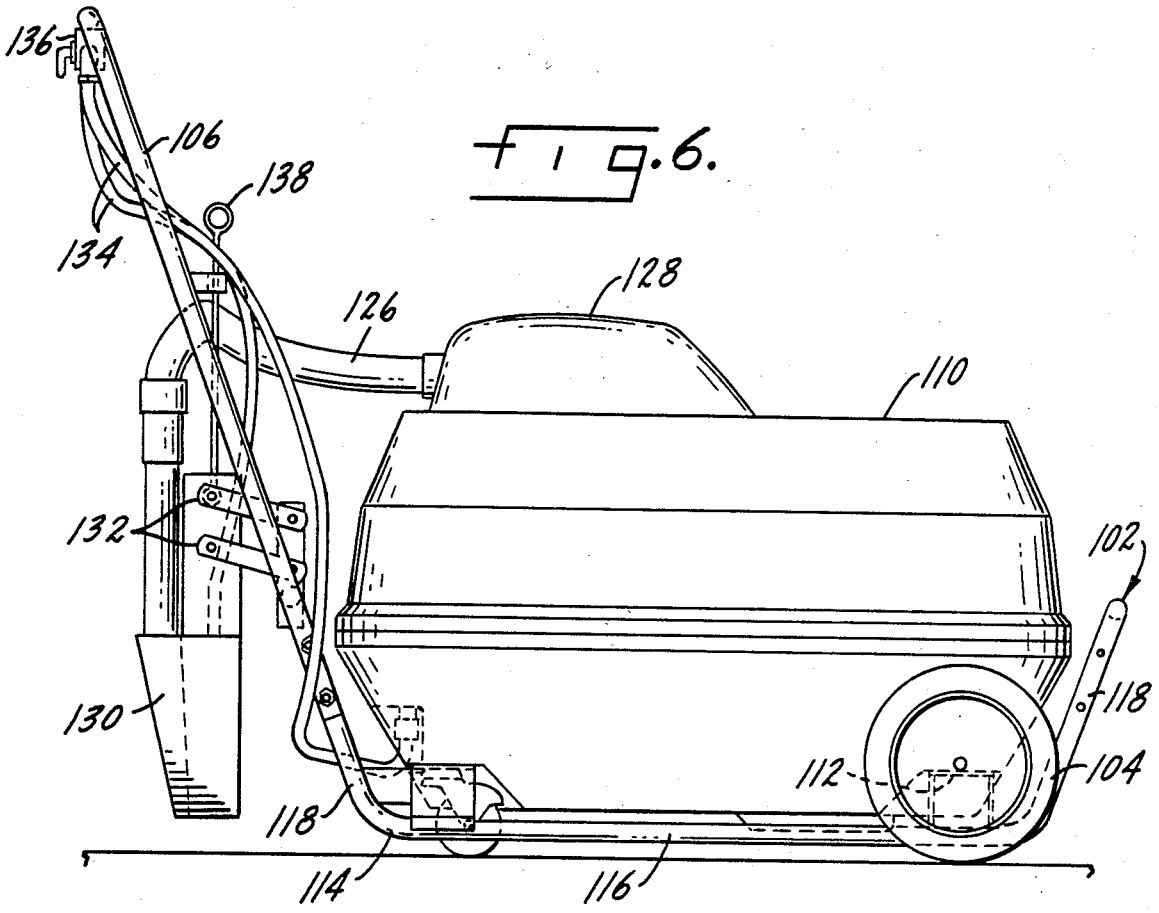
FIG. 6 is a side view of a modification.
Figure 7:
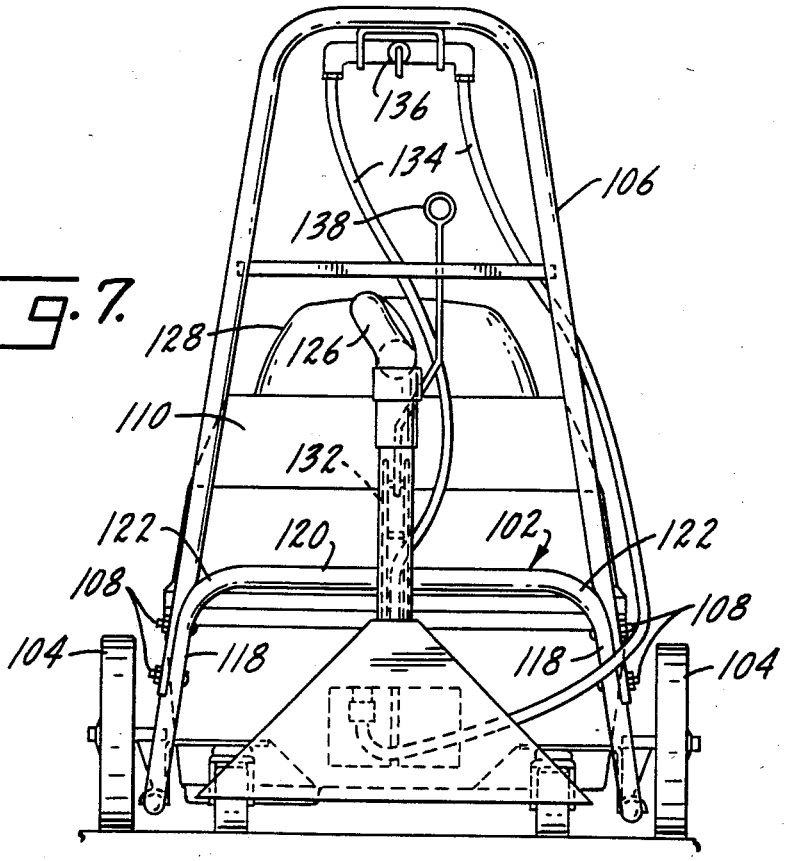
FIG. 7 is an end view of FIG. 6.

A variant form or alternative or usable supplement is shown in FIGS. 6 and 7 in which a portability cart 102 in the form of a tubular framework with wheels 104 on each side at one end and an upstanding handle 106 at the other end mounted or connected by suitable bolts 108 or the like as shown in FIG. 7. The framework may be in the nature of a series of interconnected bent tubes to provide an upwardly opening cradle arrangement for receiving and supporting an extractor or cleaning housing 110 more or less of the type indicated at 10 in FIG. 1 but without casters on the front end thereof. The front end of the housing 110 is supported on blocks or pads 112 attached to the frame elements 116 on each side while the framework of the cart fits under and around the overhang of the extractor at the rear end so that when the handle 106 is raised by the operator, the unit may be rolled forward or backward on the two wheels 104. When the operator releases the handle 106, the rear portion of the framework as at 114 will rest on the floor surface. The operator may also push the cart with all four wheels on the ground or surface.

The framework has or is made up of two longitudinally extending frame elements 116, one on each side, with upwardly angled inclines 118 at each end cross connected by laterally disposed end elements 120 with possibly integral bends 122 therebetween. The handle may be in the nature of a downwardly disposed U-shaped member with a releasable joint 108 at the extremity of each leg. The handle may be mounted at either end so that the wheels 104 may be either in front or in back.

A vacuum hose 126 is socketed into the dome 128 of the extractor unit and is connected at its lower end to an extraction shoe 130 which is attached to the rear of the cart by, for example, a parallelogram linkage arrangement 132 and a solution hose 134 which passes through a control valve 136 on the handle to supply solution to the extraction shoe like the hose 16 in FIG. 1. There also is a short suction hose 126, like or similar to the hose 14 in FIG. 1. The parallelogram mounting allows the extraction shoe 130 to float on the cart so that effective contact may be maintained between the bottom of the shoe and the surface to be cleaned independently of the up and down movement of the cart. As shown in FIG. 7, the extraction shoe 130 may have a cable or wire arrangement 138 or any other suitable mechanical device for causing or allowing the extraction shoe to be raised and releasably held in a traveling position.

One of the primary purposes of the cart is that it makes the machine easier to move around and to transport, especially up and down stairs. The cleaning head is shown as being attached to the portability cart rather than being on a hand held wand. In a sense, the cart allows conversion of a conventional floor cleaning unit, such as a carpet extractor, into a so-called automatic carpet extractor. It will be understood that the extraction shoe might have a rotating or oscillating or reciprocating brush therein, if desired. It is also recognized that the cart might be self-propelled, if that is considered desirable.

The cart may also be used to improve the mobility or transportability of an extractor unit such as in FIG. 1 with a vacuum hose and wand, in which case the head mounting 130, 132 and hose 126 would not be necessary. The regular hose and wand could project out of either end of the cart.

While the preferred form and several variations of the invention have been suggested and described, it should be understood that suitable additional modifications, changes, substitutions and alterations may be made without departing from the invention's fundamental theme.

I claim:

1. A method of operating a floor maintenance machine having a solution chamber for holding clean solution to be supplied to a floor to be cleaned, a recovery chamber for receiving dirty solution returned from the floor, two conduits and a cleaning head connected to the chambers for supplying clean solution from the solution chamber to the floor to be cleaned and for returning dirty solution to the recovery chamber, a pump for supplying clean solution from the solution chamber to the cleaning head, and a vacuum fan for creating a vacuum in the recovery chamber so that dirty solution will be drawn from the floor through the cleaning head, including the steps of establishing communication between the chambers, both above and below the normal solution level, so that solution may flow from the recovery chamber through the below communication into the solution chamber and the vacuum in the recovery chamber will be applied through the above communication to the top of the solution in the solution chamber, cleaning the dirty solution flowing through the below communication so that the dirty solution in tne recovery chamber will be cleaned before it is returned to the solution chamber to thereby operate the machine on a recycling basis, and closing both the above and below communications so that the machine may also be operated on a non-recycling basis.

2. The method of claim 1 further characterized by and including the step of venting the air space in the top of the solution chamber when the communications are closed.

3. The method of claim 1 further characterized by and including the step of movably mounting the recovery chamber relative to the solution chamber so that the recovery chamber may be emptied.

4. The method of claim 3 further characterized by and including the step of removably mounting the recovery chamber relative to the solution chamber.

5. The method of claim 1 further characterized in that the surface maintenance machine is a carpet extractor, and the conduit and cleaning head are in the form of a flexible hose and wand.

6. In a floor maintenance unit, a machine, a solution container on the machine for holding clean solution to be supplied to a floor to be cleaned, a recovery container on the machine for receiving dirty solution returned from the floor, conduits and a cleaning head connected to the containers for supplying clean solution from the solution container to the floor and for returning dirty solution from the floor to the recovery container, a pump for supplying clean solution from the solution container to the cleaning head, a vacuum fan on the machine for creating a vacuum in the recovery container so that dirty solution will be drawn from the floor through the cleaning head, ports between the containers, one above and the other below the normal solution level, so that solution may flow from the recovery container through the below port into the solution container and the vacuum in the air space in the recovery container will be communicated through the above port to the air space above the solution in the solution container, a cleaner across the below port so that dirty solution in the recovery container will be cleaned before it is returned to the solution container so that the unit may be operated on a recycling basis, and means for closing the ports so that the unit may also be operated on a non-recycling basis.

7. The structure of claim 6 further characterized by and including means for venting the air space in the top of the solution container when the ports are closed.

8. The structure of claim 6 further characterized in that the recovery container is movably mounted on the machine so that it may be emptied.

9. The structure of claim 8 further characterized in that the solution container includes a well therein, and the recovery container is removably mounted in the well.

10. The structure of claim 9 further characterized in that the port below the normal solution level is in the form of openings in the bottom of the well and recovery container, and further including means for joining the well and recovery container openings in a fluid tight releasable sealing relation.

11. The structure of claim 6 further characterized in that the surface maintenance unit is a carpet extractor, and the conduits and cleaning head are in the form of flexible hoses and a wand.

12. The structure of claim 6 in which the recovery container is removably mounted on the machine.

* * * * *